US007416568B2

(12) United States Patent
Clark

(10) Patent No.: US 7,416,568 B2
(45) Date of Patent: Aug. 26, 2008

(54) AVIATION GASOLINE COMPOSITION, ITS PREPARATION AND USE

(75) Inventor: Alisdair Quentin Clark, Aldershot (GB)

(73) Assignee: BP Oil International Limited, London (GB)

( * ) Notice: Subject to any disclaimer, the term of this patent is extended or adjusted under 35 U.S.C. 154(b) by 314 days.

(21) Appl. No.: 10/704,018

(22) Filed: Nov. 6, 2003

(65) Prior Publication Data

US 2004/0124122 A1 Jul. 1, 2004

Related U.S. Application Data

(63) Continuation-in-part of application No. 10/294,210, filed on Nov. 14, 2002, now abandoned.

(30) Foreign Application Priority Data

Nov. 14, 2002 (GB) ..... 0226587.4

(51) Int. Cl.
*C10L 1/10* (2006.01)
*C10L 1/18* (2006.01)
*C10L 1/22* (2006.01)

(52) U.S. Cl. ..... 44/300; 44/385; 44/388; 44/418; 208/15; 208/16; 208/17

(58) Field of Classification Search ..... 44/450, 44/300, 385, 388, 418; 208/15, 16, 17
See application file for complete search history.

(56) References Cited

U.S. PATENT DOCUMENTS

| | | | | |
|---|---|---|---|---|
| 5,851,241 | A | 12/1998 | Studzinski et al. | 44/359 |
| 5,880,072 | A * | 3/1999 | Furey et al. | 508/263 |
| 6,187,064 | B1 | 2/2001 | Henderson | 44/359 |
| 6,238,446 | B1 | 5/2001 | Henderson | 44/359 |
| 6,258,134 | B1 | 7/2001 | Studzinski et al. | 44/359 |
| 6,451,075 | B1 | 9/2002 | Schoppe et al. | 44/454 |
| 2002/0045785 | A1 | 4/2002 | Bazzani et al. | 585/14 |
| 2002/0055663 | A1 | 5/2002 | Barnes et al. | 585/14 |
| 2005/0044778 | A1 * | 3/2005 | Orr | 44/320 |

FOREIGN PATENT DOCUMENTS

| | | | |
|---|---|---|---|
| DE | 19744109 | 4/1999 | |
| WO | 9822556 | 5/1998 | 1/6 |
| WO | 9949003 | 9/1999 | |
| WO | 0222766 A1 | 3/2002 | 1/6 |
| WO | 0240620 | 5/2002 | |

OTHER PUBLICATIONS

Martin Robinson, http://www.iaopa.org/info/assembly21/21report_2.html, *AOPA—United Kingdom*, Oct. 1, 2002, pp. 1, 30-38.
http://www.iaopa.org/info/assembly21/index.html, *21 World Assembly Report, Presentations* index, pp. 1-2, date unknown.
http://purvisbros.com/afi/, *Aviation Fuel.info*, index, pp. 1-2, May 2, 2002.
http://purvisbros.com/afi/, *Modern US Civilian Turbine (Jet) Specifications*, pp. 1-2, Nov. 9, 2001.
http://purvisbros.com/afi/, *Modern US Military Turbine Missile Fuel Specifications*, pp. 1-2, Dec. 7, 2001.
http://purvisbros.com/afi/, *Modern US Military Turbine (Jet) Specifications*, p. 1, Nov. 21, 2001.
American Society For Testing and Materials; Standard Specification for Aviation Gasolines; Annual Book of ASTM Standards; 1999; Designation: D910-99; American Society for Testing and Materials; West Conshohocken, USA.
"Contact!"—Aircraft preservation comment and analysis, with Paul Coggan—Aeroplane, Nov. 2002 (1 page).
13 pages of text printed from web site www.aviationfuel.info, May 2, 2002.

* cited by examiner

*Primary Examiner*—Cephia D Toomer
(74) *Attorney, Agent, or Firm*—Nixon & Vanderhye

(57) ABSTRACT

An aviation gasoline composition comprising at least one tri-methyl pentane hydrocarbon and at least one $C_4$ or $C_5$ alkane wherein the amount of the at least one tri-methyl pentane in said composition is 10 to 90 vol %, the composition is substantially free of any lead compounds and the composition has a motor octane number of at least 92 and less than 98. The composition of the present invention may be made by blending together one or more process streams and may be used in a spark ignition aviation engine.

25 Claims, No Drawings

AVIATION GASOLINE COMPOSITION, ITS PREPARATION AND USE

This application is a continuation-in-part application of U.S. Ser. No. 10/294,210, entitled "Aviation Gasoline Composition, Its Preparation and Use" filed on Nov. 14, 2002 now abandoned. This application also claims priority from British Patent No. GB 0226587.4, entitled "Aviation Gasoline Composition, Its Preparation and Use" filed on Nov. 14, 2002, and U.S. Provisional Patent Application No. 60/493,030, entitled "Aviation Gasoline Composition, Its Preparation and Use" and filed Aug. 5, 2003.

The present invention relates in general to a fuel composition and in particular to an aviation gasoline (Avgas).

International Patent Publication WO 02/40620 relates to an aviation gasoline fuel composition possessing a high motor octane number and which contains reduced amounts of tetraethyl lead compound. The Avgas composition is said to preferably contain about 20 to about 80 vol % iso-octane, about 5 to about 18 vol % toluene, about 1 to about 20 vol % $C_4$ to $C_5$ paraffins, about 0 to about 1 ml/gallon tetraethyl lead (TEL) and the balance light alkylate. The motor octane number is said to be preferably greater than or equal to about 100. The fuel is said to be preferably suitable as a substitute for Grade 100LL aviation fuel. This patent publication illustrates only compositions with 0.9 ml/gallon tetraethyl lead.

There is a need for an aviation fuel which can be used in moderately powered engines (such as presently use leaded aviation gasoline with a MON of at least 91) as well as in high performance engines (such as presently use leaded aviation gasoline with a MON of at least 99.5 MON) which have been modified to use lower octane number fuels.

Thus, according to the present invention there is provided an aviation gasoline composition comprising at least one tri-methyl pentane hydrocarbon and at least one $C_4$ or $C_5$ alkane wherein the amount of the at least one tri-methyl pentane in said composition is 10 to 90 vol %, the composition is substantially free of any lead compounds and the composition has a motor octane number of at least 92 and less than 98.

The composition of the present invention solves the technical problem defined above by the presence of at least one tri-methyl pentane compound in an amount of 10-90 vol. % in the composition which, in the substantial absence of lead compounds, provides a fuel with a motor octane number of at least 92 and less than 98.

The composition of the present invention can provide the same performance in full size spark ignition aviation engines as known leaded 91/96 or 91/98 aviation gasoline, the higher MON value compensating for the absence of lead compounds such as tetraethyl lead.

The motor octane number is defined according to ASTM D2700 standard, which is known in the art.

The composition of the present invention preferably has a MON of at least 93 and more preferably of at least 94.

By substantially free of lead compounds is meant that the amount of lead compounds in the composition according to the present invention is not greater than 0.003 g of lead per litre. Lead compounds in particular which should be absent include tetraethyl lead.

The at least one tri-methyl pentane preferably comprises 2,2,4-trimethylpentane (herein referred to as iso-octane). Iso-octane may be prepared as described in WO 02/40620, the contents of which are incorporated by reference. Iso-octane may be prepared by the hydrogenation of di-isobutylene, which in turn may be prepared by the dimerisation of isobutenes. Such dimerisation may be performed using converted MTBE production facilities.

The at least one tri-methyl pentane may be provided as a substantially pure component and/or as a component in one or more alkylate process streams.

The composition of the present invention comprises at least one tri-methyl pentane (from whatever source) in an amount of 10-90 vol %, preferably 40-90 vol %, more preferably 60-90 vol %.

The composition of the present invention may comprise at least 0.01 vol % $C_4$ alkane. The composition of the present invention may comprise less than 5 vol %, preferably less than 2 vol % $C_4$ alkane. The composition of the present invention may comprise at least 10 vol % $C_5$ alkane. The composition of the present invention may comprise less than 40 vol %, preferably less than 20 vol % $C_5$ alkane. 2-methyl butane is preferred over n-pentane.

The composition of the present invention may optionally comprise alkylate in an amount of up to 90 vol %, for example up to 70 vol %. Preferably, the alkylate if present in the composition of the present invention, has been distilled such that it has a boiling point not greater than 170° C. The alkylate component may comprise at least one tri-methyl pentane.

The composition of the present invention may comprise isomerate and/or isopentane (2-methyl butane) in a combined total amount of up to 40 vol %, preferably in an amount of less than 20 vol %. Isopentane used in the composition of the present invention may be provided as a substantially pure component and/or as a component in a $C_5$ refinery stream, for example from an isomerisation unit.

The composition of the present invention may optionally comprise hydrocrackate. If present in the composition of the present invention, the amount of hydrocrackate is preferably up to 40 vol %, more preferably up to 20 vol %.

Aromatics may optionally be present in the composition of the present invention in an amount of up to 30 vol %, preferably up to 25 vol %. Toluene is optionally present in the composition of the present invention in an amount of up to 30 vol %. Preferably, the amount of toluene, if present in the composition of the present invention, is less than 20 vol %, more preferably not greater than 10 vol %. Other aromatic compounds, for example ethylbenzene and xylene, may be present in the composition of the present invention in place of or in addition to toluene. Such aromatic compounds may be obtained by distillation of a process stream from a catalytic reformer.

Naphtha may be present in the composition of the present invention. If present in the composition of the present invention, the amount of naphtha is preferably not greater than 30 vol %, and more preferably is less than 10 vol %.

Olefins are preferably not present in the composition of the present invention, but their presence is not excluded.

The composition of the present invention may comprise a dye, or may be undyed. The composition of the present invention may comprise one or more anti-oxidants such as hindered phenols.

The composition of the present invention may comprise one or more lubricity improvers such as acids, esters and/or amides. Biofuel may also be present in the composition of the present invention. The composition of the present invention may comprise one or more additives to reduce valve seat recession, such as phosphorus, potassium or sodium based valve seat recession additives.

The composition of the present invention may independently have one or more of the features listed in Table 1 below and preferably all of the features.

TABLE 1

| Feature | Range/value |
|---|---|
| Vapour pressure | 38 to 49 kPa |
| Distillation properties: | |
| 10% evaporation | by 75° C. max |
| 40% evaporation | by 75° C. min |
| 50% evaporation | by 105° C. max |
| 90% evaporation | by 135° C. max |
| Final boiling point | <170° C. |
| Supercharge | Not specified, or >96 or >98 ON |
| Calorific value | >43.5 Mj/kg |
| Freezing point | Less than or equal to −58° C. |

Preferably, the composition of the present invention meets the Def Stan 91-90 standard and/or ASTM D910 standards with the provisos (i) that the MON value is at least 92 and less than 98 (ii) the supercharge is unspecified or at least 96 and (iii) the composition is substantially free of any lead compounds.

The composition of the present invention may be made by blending together one or more process streams selected from the group consisting of iso-octane, alkylate, isopentane, isomerate, hydrocrackate, aromatics and naphtha streams. Preferably, the composition of the present invention is made by adding to one or more of these process streams or a blend thereof, one or more aviation gasoline additives selected from the group consisting of dye, anti-oxidants, lubricity improvers and additives to reduce valve seat recession.

The composition of the present invention may further comprise at least one fuel system icing inhibitor. Such icing inhibitors are preferably added at the point of use of the composition. Suitable fuel system icing inhibitors comprise alcohols or ethers for example diethylene glycol monomethyl ether and isopropanol. The icing inhibitor may be used in an amount of up to 5% by volume in the fuel composition.

The composition of the present invention may be used in spark ignition aviation engines. The aviation engines may be capable of operating at 30 metres or more above sea level. The aviation engines may be used to propel heavier than air craft such as light aircraft. The aviation engines may be used to propel lighter than air craft such as airships. Thus, according to a further embodiment of the present invention there is provided a method of operating a spark ignition aviation engine which comprises providing said engine with an aviation gasoline composition comprising at least one tri-methyl pentane hydrocarbon and at least one $C_4$ or $C_5$ alkane wherein the amount of the at least one tri-methyl pentane in said composition is 10 to 90 vol %, the composition is substantially free of any lead compounds and the composition has a motor octane number of at least 92 and less than 98.

The present invention will now be illustrated by reference only to the following examples. Compositions were prepared by blending amounts of components as listed in Table 2 below.

TABLE 2

| Component | Example 1 (W02/421) Amount | Example 2 (W02/579) Amount |
|---|---|---|
| Alkylate, initial boiling point to 170° C. fraction * | 24 vol % | 24 vol % |
| Naphtha | 2.4 vol % | — |
| Toluene | 8 vol % | 8 vol % |
| Isopentane | 16 vol % | 16 vol % |
| Iso-octane | 49.6 vol % | 52 vol % |

* the alkylate fraction comprised approximately 30 vol % iso-octane such that the total amount of iso-octane in the composition was about 60 vol %.

The properties of the compositions were determined and these are listed in Table 3 below.

TABLE 3

| Property | Units | W02/421 | W02/579 |
|---|---|---|---|
| MON | | 93.2 | 95.0 |
| Supercharge | | 99 | 99 |
| Lead | gPb/liter | 0.00 | 0.00 |
| D1319 FIA Aromatics | % v/v | 6.5 | 7.4 |
| D1319 FIA Olefins | % v/v | 0.6 | 0 |
| D1319 FIA Saturates | % v/v | 92.9 | 92.6 |
| D3338 Specific Energy | MJ/kg | 44.086 | 44.071 |
| D381 Existent Gum (Air) | Mg/100 ml | 1 | <1 |
| IP365 Composite Density | $kg/m^3$ | 700.9 | 698.8 |
| D86 Initial Boiling Point | ° C. | 39.7 | 32.5 |
| D86 Final Boiling Point | ° C. | 123.4 | 119.5 |
| D86 Loss | % v/v | 0.6 | 0.5 |
| D86 Recovery | % v/v | 98.3 | 99.0 |
| D86 Residue | % v/v | 1.1 | 0.5 |
| D86 10% Evaporated | ° C. | 67.1 | 69.5 |
| D86 40% Evaporated | ° C. | 96.2 | 96.0 |
| D86 50% Evaporated | ° C. | 99.3 | 98.5 |
| D86 90% Evaporated | ° C. | 104.0 | 101.0 |
| D86 Sum of 10% and 50% Evaporated temps | ° C. | 166.4 | 168.0 |
| D873 16 Hr Accelerated Gum | Mg/100 ml | 3 | 1 |
| D873 Lead Precipitate | Mg/100 ml | 0 | 0 |
| IP16 Freeze point | ° C. | <−80 | <−60 |
| IP154 Copper Corrosion 2 Hrs @100° C. | — | 1a | 1 |
| IP289 Water Reaction Interface Rating | — | 1 | 1b |
| IP289 Water Reaction Volume change | — | 0 | 0 |
| Vapour Pressure | KPa | 45.1 | 41.1 |
| Sulphur (D2622mod) | % w/w | 0.0011 | 0.0010 |
| Anti-oxidant | mg/L | 12 | 12 |

The properties of the compositions show that these are suitable for use as aviation gasolines, in particular, the compositions of the present invention meet the Def Stan 91-90 standard and/or ASTM D910 standards with the provisos (i) that the MON value is at least 92 and less than 98 (ii) the supercharge is unspecified or at least 96 and (iii) the composition is substantially free of any lead compounds.

What is claimed is:

1. An aviation gasoline composition comprising 2,2,4-trimethylpentane and at least one $C_4$ or $C_5$ alkane wherein the amount of 2,2,4-trimethylpentane in said composition is 60 to 90 vol %, the composition comprises at least 0.01 vol % $C_4$ alkane and at least 10 vol % $C_5$ alkane, the composition is substantially free of any lead compounds, aromatics are present in the composition in an amount of up to 30 vol % and the composition has a motor octane number of 92 to 95, a final boiling point of less than 170° C. and in which tetraethyl lead is absent.

2. A composition as claimed in claim 1 in which the composition has a motor octane number of at least 93.

3. A composition as claimed in claim 1 in which the composition further comprises a dye.

4. A composition as claimed in claim 1 in which the composition further comprises one or more anti-oxidants.

5. A composition as claimed in claim 1 in which the composition further comprises one or more lubricity improvers.

6. A composition as claimed in claim 1 in which the composition further comprises biofuel.

7. A composition as claimed in claim 1 in which the composition further comprises one or more additives to reduce valve seat recession.

8. A method of operating a spark ignition aviation engine which comprises providing said engine with an aviation gasoline composition as claimed in claim 1.

9. A method as claimed in claim 8 which further comprises adding to said aviation gasoline composition, at the point of use, at least one fuel system icing inhibitor.

10. A method of making an aviation gasoline composition which comprises blending together one or more process streams selected from the group consisting of iso-octane, alkylate, isopentane, isomerate, hydrocrackate, aromatics and naphtha streams to make a composition as claimed in claim 1.

11. A method as claimed in claim 10 which further comprises adding to one or more of said process streams or a blend thereof, one or more aviation gasoline additives selected from the group consisting of dye, anti-oxidants, lubricity improvers and additives to reduce valve seat recession.

12. A composition as claimed in claim 1 made by a method which comprises blending together one or more process streams selected from the group consisting of iso-octane, alkylate, isopentane, isomerate, hydrocrackate, aromatics and naphtha streams.

13. A composition as claimed in claim 2 in which the composition has a motor octane number of at least 94.

14. A composition as claimed in claim 2 in which the composition further comprises one or more additives to reduce valve seat recession.

15. A composition as claimed in claim 13 in which the composition further comprises one or more additives to reduce valve seat recession.

16. A composition as claimed in claim 12 in which the composition comprises alkylate in an amount of up to 90 vol %.

17. A composition as claimed in claim 16 in which the alkylate has been distilled such that it has a boiling point not greater than 170° C.

18. A composition as claimed in claim 12 in which the composition comprises isomerate and/or isopentane (2-methyl butane) in a combined total amount of up to 40 vol %.

19. A composition as claimed in claim 18 in which the composition comprises isomerate and/or isopentane (2-methyl butane) in a combined total amount of less than 20 vol %.

20. A composition as claimed in claim 12 in which the composition comprises aromatics in an amount of up to 25 vol %.

21. A composition as claimed in claim 4 in which the anti-oxidants are hindered phenols.

22. A composition as claimed in claim 5 in which the lubricity improvers are one or more of acids, esters and amides.

23. A composition as claimed in claim 7 in which the additives to reduce valve seat recession are phosphorus, potassium or sodium based valve seat recession additives.

24. A composition as claimed in claim 14 in which the additives to reduce valve seat recession are phosphorus, potassium or sodium based valve seat recession additives.

25. A composition as claimed in claim 15 in which the additives to reduce valve seat recession are phosphorus, potassium or sodium based valve seat recession additives.

* * * * *